US007001040B2

(12) United States Patent
Wu

(10) Patent No.: US 7,001,040 B2
(45) Date of Patent: Feb. 21, 2006

(54) LOCKING STRUCTURE OF CEILING LAMP FOR LOCKING CEILING LAMP TO WIRE WINDING BOX

(76) Inventor: Wen-Chang Wu, 235 Chung-Ho Box 8-24, Taipei (TW)

( * ) Notice: Subject to any disclaimer, the term of this patent is extended or adjusted under 35 U.S.C. 154(b) by 80 days.

(21) Appl. No.: 10/741,186

(22) Filed: Dec. 19, 2003

(65) Prior Publication Data

US 2004/0246708 A1 Dec. 9, 2004

Related U.S. Application Data

(63) Continuation-in-part of application No. 10/452,864, filed on Jun. 3, 2003.

(51) Int. Cl.
*F21S 8/00* (2006.01)

(52) U.S. Cl. ..... 362/147; 362/406; 362/148; 362/249

(58) Field of Classification Search ..... 362/147, 362/406, 404, 148, 249, 405; 348/342, 343; 416/5

See application file for complete search history.

(56) References Cited

U.S. PATENT DOCUMENTS

2004/0042222 A1 * 3/2004 Childs ..... 362/432

* cited by examiner

*Primary Examiner*—Sandra O'Shea
*Assistant Examiner*—Sharon Payne

(57) ABSTRACT

A locking structure of a ceiling lamp for locking a ceiling lamp to a wire winding box comprises a retaining sheet locking to a bottom of a wire winding box and a plug inserting through the retaining sheet. A middle part of the retaining sheet has a positioning hole formed by overlapping a large size hole and a small size hole. A reed has a round buckling surface with a notch. The round buckling surface covers upon the large size hole. One end of the plug is locked with a nut. After the plug passing through the positioning hole of the retaining sheet from the large size hole to the small size hole, a lower end of the nut resisting against the small size hole of the positioning hole so that the plug is positioned to the retaining sheet.

5 Claims, 4 Drawing Sheets

Fig. 1-A

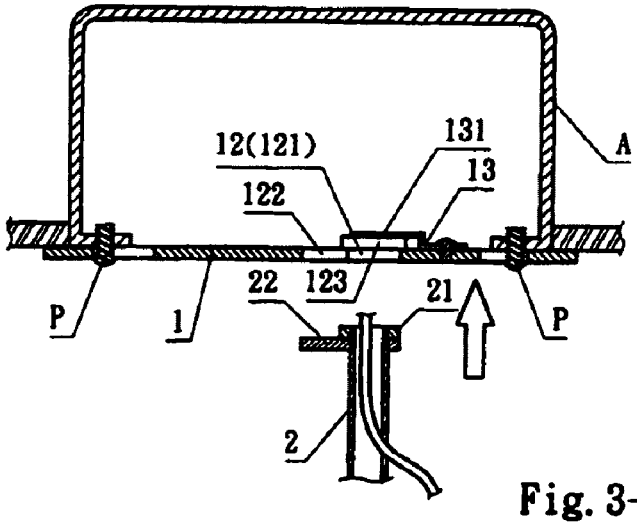
Fig. 3-A
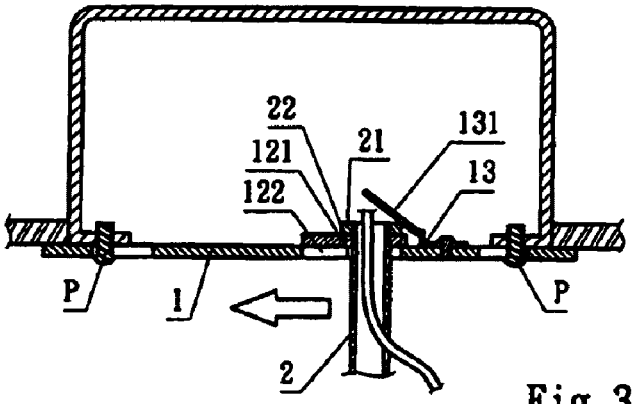
Fig. 3-B
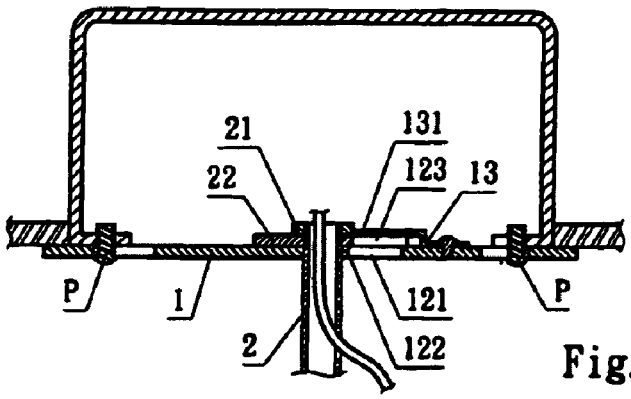
Fig. 3-C

LOCKING STRUCTURE OF CEILING LAMP FOR LOCKING CEILING LAMP TO WIRE WINDING BOX

This application is a continuation in part (CIP) of U.S. patent Ser. No. 10/452,864 filed at Jun. 3, 2003, which is assigned to and has the same inventor as the inventor of the present invention. Thus, the contents of U.S. patent Ser. No. 10/452,864 are incorporated into the present invention as a part of specification of the present invention.

FIELD OF THE INVENTION

The present invention relates to lamp assembly devices, and particularly to a rapid assembled and detached structure of a lamp. By the design of the present invention, a user can assemble the lamp rod by inserting it into a lamp seat easily; thus, the lamp is detachable for storage and transfer with a smaller volume.

BACKGROUND OF THE INVENTION

The prior art buckling structures of lamps, such as wall lamps, seat lamps, or stand lamps, are assembled by screwing studs with nuts. Not only collision events easy occur, but also the locking tools (for example, spanners, openers, etc.) are necessary in assembly. In assembly, the wires will expose so as to generate electric shock. Moreover, the assembly work is tedious and thus it is unsuitable for being assembled by the users themselves. Therefore, generally, the wire winding box is assembled with the inserting rod before sale. The cost is high and a larger space is necessary for transfer and storage.

SUMMARY OF THE INVENTION

Accordingly, the primary object of the present invention is to provide a locking structure of a ceiling lamp for locking a ceiling lamp to a wire winding box. The locking structure comprises a retaining sheet locking to a bottom of a wire winding box and a plug inserting through the retaining sheet. A middle part of the retaining sheet has a positioning hole formed by overlapping a large size hole and a small size hole. A reed has a round buckling surface with a notch. The round buckling surface covers upon the large size hole. One end of the plug being locked with a nut. After the plug passing through the positioning hole of the retaining sheet from the large size hole to the small size hole. A lower end of the nut resisting against the small size hole of the positioning hole so that the plug is positioned to the retaining sheet.

The various objects and advantages of the present invention will be more readily understood from the following detailed description when read in conjunction with the appended drawing.

BRIEF DESCRIPTION OF THE DRAWINGS

FIG. 1A is a partial view about another embodiment of the present invention.

FIG. 3A shows one embodiment before the insertion of the lamp rod.

FIG. 3B shows the embodiment of FIG. 3A where the lamp rod is being inserted.

FIG. 3C shows the embodiment of FIG. 3A after the insertion of the lamp rod.

DETAILED DESCRIPTION OF THE INVENTION

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
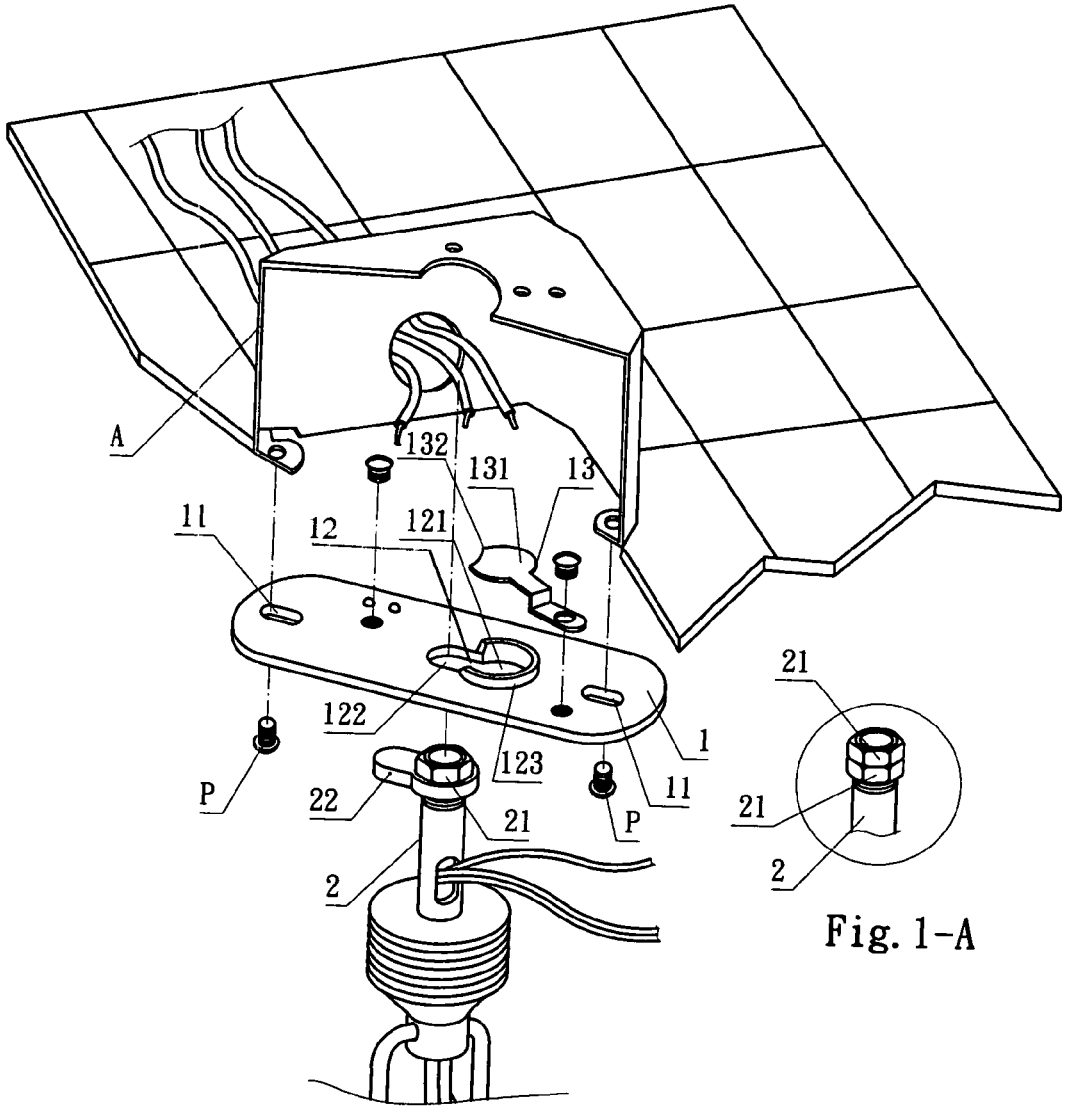
FIG. 1 is an exploded perspective view of the present invention.
Figure 2:
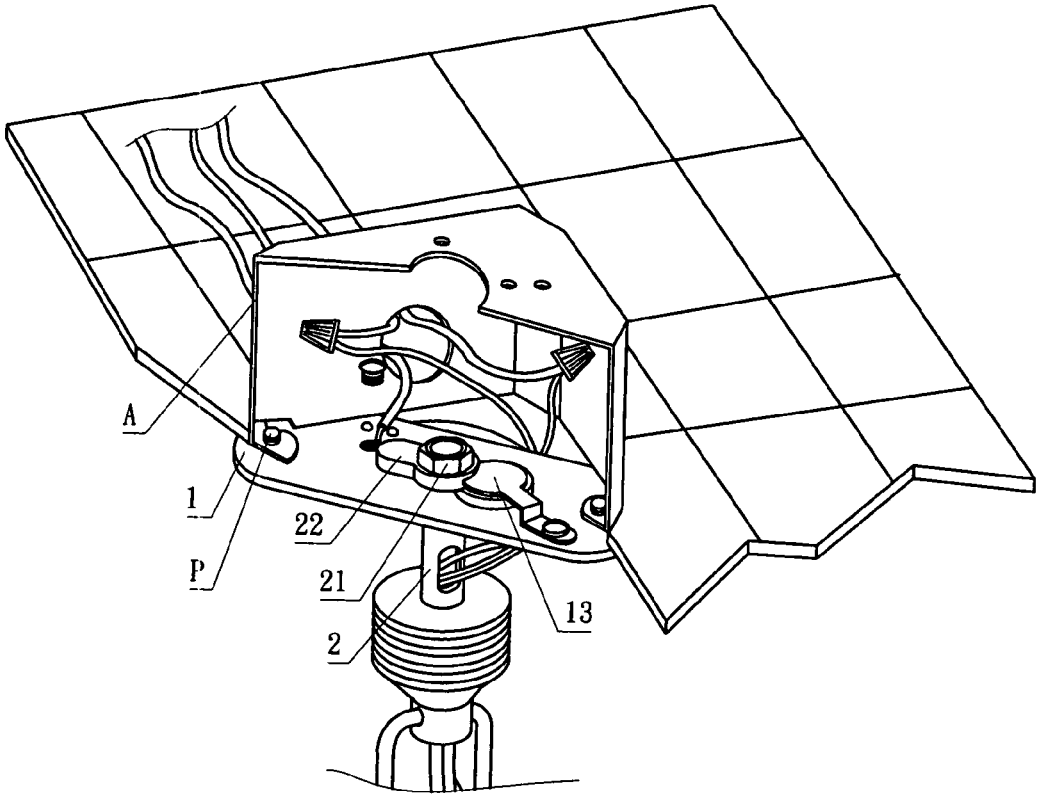
FIG. 2 is an assembled perspective view of the present invention.

With reference to FIGS. 1 and 2, the structure of the present invention is illustrated. The present invention is formed by a retaining sheet 1 locking to a bottom of a wire winding box A and a plug 2 inserting through the retaining sheet 1.

Each of two sides of the retaining sheet 1 has a respective through hole 11. Thereby, a stud P can pass through the through hole 11 to lock the retaining sheet 1 to the bottom of the wire winding box A. A middle part of the retaining sheet 1 has a positioning hole 12. The positioning hole 12 is formed by overlapping a large size hole 121 and a small size hole 122. A periphery of the large size hole 121 is protruded with a protruding edge 123. A reed 13 has one end fixed to the retaining sheet 1 and another end of the reed 13 has a round buckling surface 131 with a notch 132. The round buckling surface 131 covers upon the large size hole 121. The configuration of the notch 132 is corresponding to the round edge of the small size hole 122.

One end of the plug 2 is locked with a nut 21 and a buckling block 22 (or in another embodiment, one end of the plug 2 is locked with two nuts 21, one at an upper side and the other is at a lower side, as shown in FIG. 1-A). After the plug 2 passes through the positioning hole 12 of the retaining sheet 1 from a lower side of the retaining sheet 1, a lower end of the nut 21 resists against the small size hole 122 of the positioning hole 12 so that the plug 2 is positioned to the retaining sheet 1.

With reference to FIG. 3, the operation of the present invention will be described herein. The reed 13 covers upon the protruding edge 123 above the positioning hole 12, when the plug 2 inserted into the retaining sheet 1 from a lower side thereof, the plug 2 is firstly coupled to the large size end 121 of the positioning hole 12 and ejects the round buckling surface 131 upwards (referring to FIG. 3B). When the nut 21 and the buckling block 22 of the plug 2 are released from the confinement of the protruding edge 123 of the positioning hole 12, the plug 2 moves toward the small size hole 122 so that the buckling block 22 locking to the plug 2 is above the small size hole. Then the reed 13 returns to the original position so that the notch 132 of the reed 13 resists against the edge of the buckling block 22. Thereby, the plug 2 is fixed to the positioning hole 12 of the retaining sheet 1 (referring to FIG. 3).

Thereby, from above said structure, a user can assemble the lamp rod by inserting it into the lamp seat easily; thus, the lamp is detachable for storage and transfer with a smaller volume.

Figure 4:
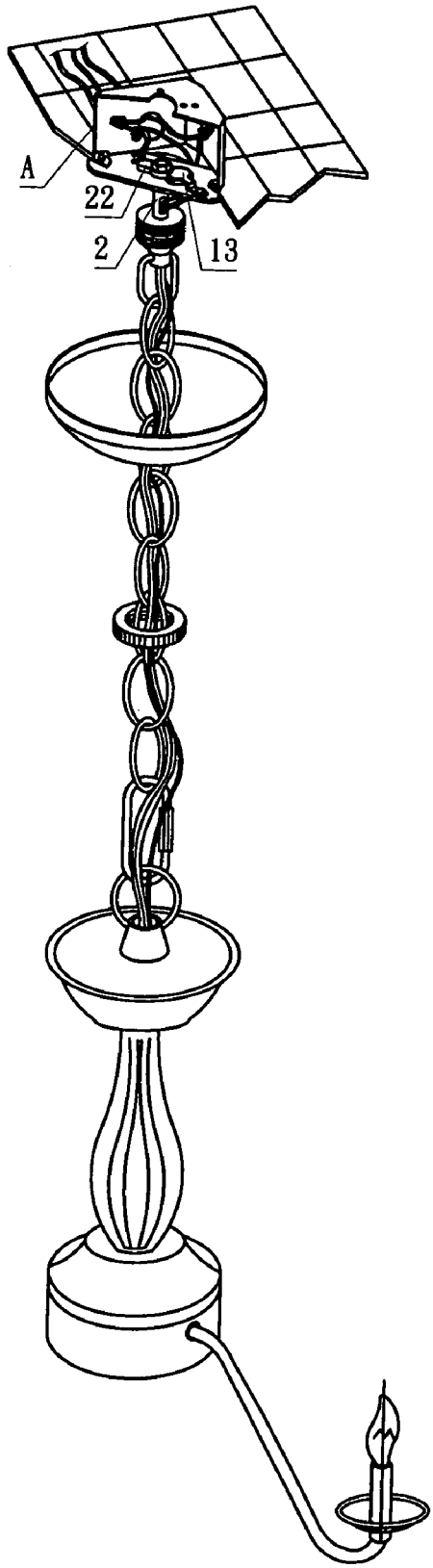
FIG. 4 shows an application of the present invention.

With reference to FIG. 4, one embodiment of the present invention is illustrated, wherein it is shown that the present invention is assembled to a ceiling lamp.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A locking structure of a ceiling lamp for locking a ceiling lamp to a wire winding box; the locking structure comprising:

a retaining sheet locking to a bottom of a wire winding box; a middle part of the retaining sheet having a positioning hole; the positioning hole being formed by overlapping a large size hole and a small size hole; a reed having one end fixed to the retaining sheet and another end of the reed having a round buckling surface with a notch; the round buckling surface covering upon the large size hole; the configuration of the notch corresponding to the round edge of the small size hole; and a plug inserting through the retaining sheet; one end of the plug being locked with a nut; after the plug passing through the positioning hole of the retaining sheet from a lower side of the retaining sheet, a lower end of the nut resisting against the small size hole of the position ing hole so that the plug is positioned to the retaining sheet;

wherein in assembly, the plug is firstly inserted into the large size hole by passing the nut through the large size hole and then moves to the small size hole so as to fix in the small size hole, while an edge of the notch of the round buckling surface of the reed resists against the plug.

2. The locking structure of a ceiling lamp as claimed in claim 1, wherein each of two sides of the retaining sheet has a respective through hole; a stud passes through the through hole to lock the retaining sheet to the bottom of the wire winding box.

3. The locking structure of a ceiling lamp as claimed in claim 1, wherein a periphery of the large size hole is protruded with a protruding edge.

4. The locking structure of a ceiling lamp as claimed in claim 1, wherein the plug has a buckling block positioned below the nut.

5. The locking structure of a ceiling lamp as claimed in claim 1, wherein the plug has another nut positioned below the nut.

* * * * *